US011957219B2

(12) United States Patent
Sahagun et al.

(10) Patent No.: US 11,957,219 B2
(45) Date of Patent: Apr. 16, 2024

(54) MULTIFUNCTIONAL SNAP SYSTEM

(71) Applicants: Lauren Sahagun, Fairfax, VA (US); Nicholas Sahagun, Fairfax, VA (US)

(72) Inventors: Lauren Sahagun, Fairfax, VA (US); Nicholas Sahagun, Fairfax, VA (US)

( * ) Notice: Subject to any disclaimer, the term of this patent is extended or adjusted under 35 U.S.C. 154(b) by 0 days.

(21) Appl. No.: 17/867,717

(22) Filed: Jul. 19, 2022

(65) Prior Publication Data

US 2023/0014702 A1 Jan. 19, 2023

Related U.S. Application Data

(60) Provisional application No. 63/223,228, filed on Jul. 19, 2021.

(51) Int. Cl.
*A44B 17/00* (2006.01)

(52) U.S. Cl.
CPC ..... *A44B 17/007* (2013.01); *A44B 17/0076* (2013.01)

(58) Field of Classification Search
CPC . A44B 17/00; A44B 17/0035; A44B 17/0052; A44B 17/007; A44B 17/0076
See application file for complete search history.

(56) References Cited

U.S. PATENT DOCUMENTS 3,757,389 A 9/1973 Wiland
5,490,309 A * 2/1996 Velasquez ..... A44B 17/0035 24/104
7,089,634 B1 8/2006 Dunning
7,150,081 B2 12/2006 Juan
7,703,180 B2 4/2010 Raccosta
7,735,235 B2 * 6/2010 Waddell ..... F16B 5/0692 33/669
7,752,718 B2 7/2010 Fisher et al.
7,761,940 B2 7/2010 Hipp
8,122,572 B2 * 2/2012 Waddell ..... F16B 5/0692 24/453
D662,807 S * 7/2012 Waddell ..... D8/382
8,572,822 B2 * 11/2013 Hasegawa ..... A44B 17/0088 24/108
9,254,046 B1 2/2016 Arenstein
(Continued)

OTHER PUBLICATIONS

"DOT® Snap Fastener Cloth-to-Cloth Set (Stainless Steel)," Sailrite.com. https://www.sailrite.com/Snap-Fastener-Cloth-to-Cloth-with-Buttons-Stainless-Steel?gclid=Cj0KCQiAvvKBBhCXARIsACTePW9qjS2gOil2tCrH8uJCWMb7d5Z_8wDYmAnj2eem-paH7ne59KL39IYaAurWEALw_wcB [Date accessed: Mar. 9, 2021].

*Primary Examiner* — Robert Sandy
*Assistant Examiner* — Michael S Lee
(74) *Attorney, Agent, or Firm* — Bold IP, PLLC

(57) ABSTRACT

A fastener element used to couple one or more items together, including layers of fabrics or other materials. The fastener element includes a top element having a central opening with a closed bottom surface adjoining a ring. On an underside of the ring is a protruding, piercing element that. The fastener element allows for more than two layers to be fastened together in a snap system and for a plurality of layers to be joined together. The fastener element can allow multiple layers to be joined together by coupling a first socket of a snap system to the top element and another socket to an underside of the ring and to the protruding piercing element. The fastener element can be used for multiple applications to secure more than one layer of fabric or another material together.

20 Claims, 15 Drawing Sheets

(56) References Cited

U.S. PATENT DOCUMENTS

| | | | | |
|---|---|---|---|---|
| 9,839,263 | B2 | 12/2017 | Villa et al. | |
| 9,986,794 | B2 | 6/2018 | Greenspoon | |
| 2002/0029444 | A1 | 3/2002 | Lyle et al. | |
| 2009/0119959 | A1 | 5/2009 | Brown | |
| 2011/0094071 | A1* | 4/2011 | Veldhoen | F16B 5/0692 24/598.4 |

* cited by examiner

MULTIFUNCTIONAL SNAP SYSTEM

CROSS-REFERENCE TO RELATED APPLICATIONS

This application is a non-provisional application which claims priority to U.S. Provisional Patent Application No. 63/223,228 filed on Jul. 19, 2021, which is incorporated by reference in its entirety.

FIELD OF THE DISCLOSURE

The present invention relates to a new system and method for using snaps that can connect multiple pieces of fabrics or other elements together in an unlimited manner.

BACKGROUND

Snaps are a type of fasteners that may be used on articles of clothing and many other types of items. Snaps usually include two or pair of interlocking discs, that may be made from either metal or plastic or a combination thereof. Snaps are sometimes used in place of traditional buttons, and may be used to fasten clothing, fabrics, cushions, and other items for attachment purposes. Notably, snaps as currently designed do not allow for more than one or two layers to be attached together.

Accordingly, there is a need for an alternative to the existing form and structure of snaps that may allow for connecting multiple layers together for a variety of applications and purposes.

SUMMARY

The present description includes one or more non-limiting embodiments for a snap jack fastener comprising a single snap jack fastener body, having a top protruding element with an internal, central cavity, a ring, and a pointing, piercing member on an underside of the same ring. In more detail, in one or more non-limiting embodiment, the top protruding element comprises a central opening having a closed bottom surface, a ring that encircles the top protruding element at a lowermost end of the top protruding element, whereby the top protruding element extends upwardly away from a recessed top surface of the ring. Further, the diameter of the ring may be wider than a diameter of the top protruding element. The bottom protruding element or member of the snap jack fastener may further include a bottom protruding element that has a pointed, piercing end, whereby the bottom protruding element extends downwardly away from a recessed bottom surface on an underside of the ring. In a non-limiting embodiment, the top protruding element is cylindrically shaped. Further, the central opening of the top protruding element does not extend all the way through to the underside of the ring and is stopped at the closed bottom surface of the top protruding element. The closed bottom surface of the top protruding element may be visible from the central opening. In a non-limiting embodiment, the bottom protruding member of the snap jack fastener comprises a threaded screw instead of a smooth piercing end or a cone shaped barb so that the threaded screw can be coupled with a threaded socket and can be used to fasten more securely to various fabrics having different textures and thicknesses.

Further, in a non-limiting embodiment, the top protruding element of the snap jack fastener further comprises a first lip, a second lip, and a third lip protruding outwardly from a top edge of the top protruding element. The snap jack fastener may be part of an overall snap system for snapping together a plurality of layers of fabric or another material, whereby the plurality of layers comprises a number greater than at least two layers.

In one or more non-limiting embodiment, the bottom protruding member of the snap jack fastener comprises a cone shaped barb have a pointed, piercing end.

In a non-limiting embodiment, the present description further includes details relating to a method for using a snap jack fastener to connect a plurality of layers using a snap system. The method may include providing one or more caps, one or more studs, and one or more sockets as part of the snap system, as well as one or more snap jack fasteners. The method may include inserting a pointed end of a first cap into a first layer of fabric or another material and then coupling a first socket to the pointed end of the first cap. The method may further include coupling a first snap jack fastener to an underside of the first socket, wherein a top protruding element of the first snap jack fastener fits within an internal cavity of the first socket and inserting a pointed, piercing end of the first snap jacket into a second layer of fabric or another material. The method may further include coupling a second socket to the first snap jack fastener, wherein the pointed, piercing end of the first snap jack fastener extends through the second layer of fabric or another material and fits within an internal cavity of the second socket and coupling a second snap jack fastener to the second socket, wherein a top protruding element of the second snap jack fastener fits within an internal cavity of the second socket. The method may further include adding a third layer of fabric or another material, and inserting a pointed, piercing end of the second snap jack fastener into the third layer of fabric layer or another material. The method may further include adding additional sockets, snap jack fasteners, and additional layers as desired in a same order as the steps described above. Once a terminal layer of fabric or another material is provided, the method may further include inserting a pointed end of a terminal cap up through the terminal layer of fabric or another material and into a stud that is coupled to a terminal socket.

In a non-limiting embodiment, the snap jack fastener is part of an overall snap system for snapping together a plurality of layers of fabric or another any type of non-fabric material, wherein the plurality of layers comprises a number greater than at least two layers. Further, in a non-limiting embodiment, the first layer, the second layer, and the additional layers of fabric or another material are part of a bedding system, a tent securing system, a stroller covering securing system, or a boat covering securing system.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description is drawn to a novel multifunctional snap system that may be used to attach multiple layers of fabric and/or other materials and/or other items together using the snap jack element described herein. Advantageously, the snap jack fastener device allows a plurality of layers to be attached, whereby at least two or more layers may be attached and removably secured together. Further details are provided with reference to the Figures.

Figure 1A:
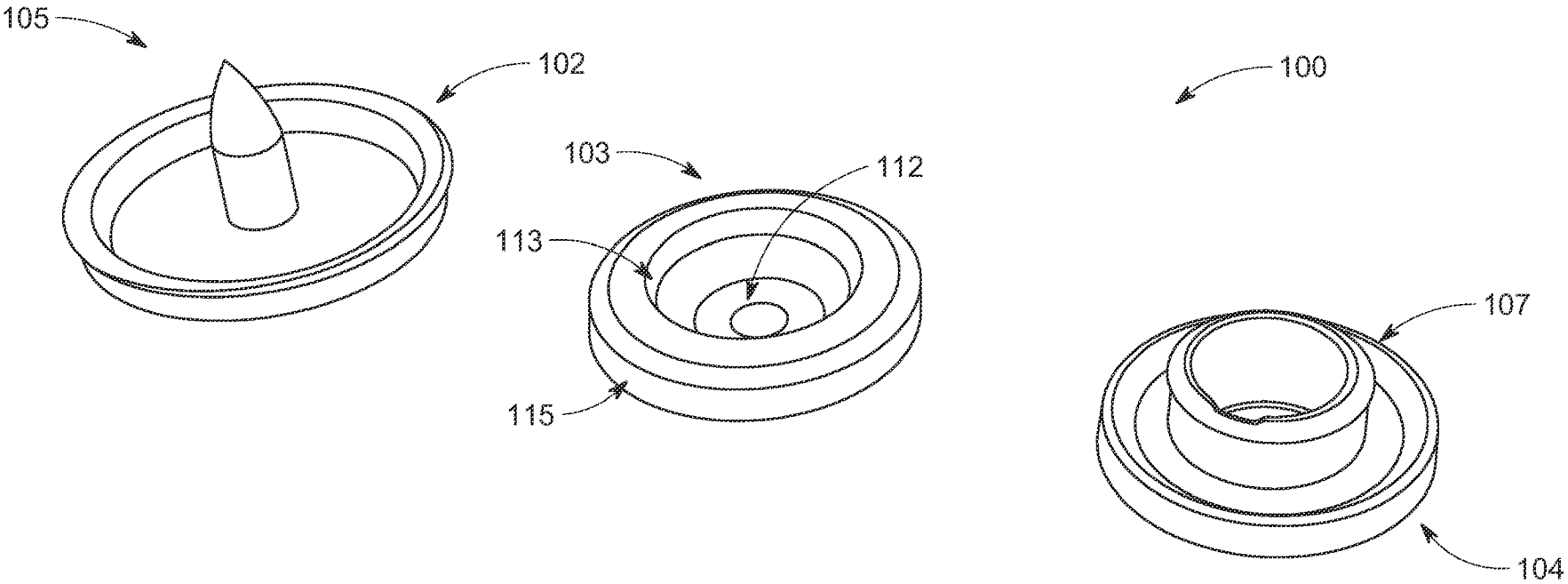
FIG. 1A (PRIOR ART)
FIG. 1A depicts a prior art three piece snap system.

FIG. 1A depicts a pictorial illustration of a prior art, existing snap system. The existing snap system 100 includes a cap 102, a socket 103, and a stud 104. The snap system 100 may be used to attach the cap 102 to one side of a fabric or other item into a created or existing hole/opening in the fabric or other item. The socket 103 is affixed using specialized tools to the other side of the fabric or other item to the cap 102, and then the stud 104 is affixed using specialized tools to a second piece of fabric or other item in a created or existing hole/opening. The stud 104 can be brought towards the combination stud 102 and socket 103 and in this manner the snap system 100 is made functional to attach or fasten two pieces of fabric or other items together.

The cap 102 includes a pointed barb 105, as shown in FIG. 1A. The pointed barb 105 is usually sharper and used to pierce through a material. The socket 103 may include a socket opening 112 that extends from a top side 113 of the socket 103 to the bottom side 115 of the socket 103. The stud 104 may include a protruding element 107 that protrudes from one side of the stud 104. The protruding element 107 of the stud 104 may have a cylindrical cross-section and shape and may not be as sharp as the piercing barb 105 of the cap 102.

Figure 1B:
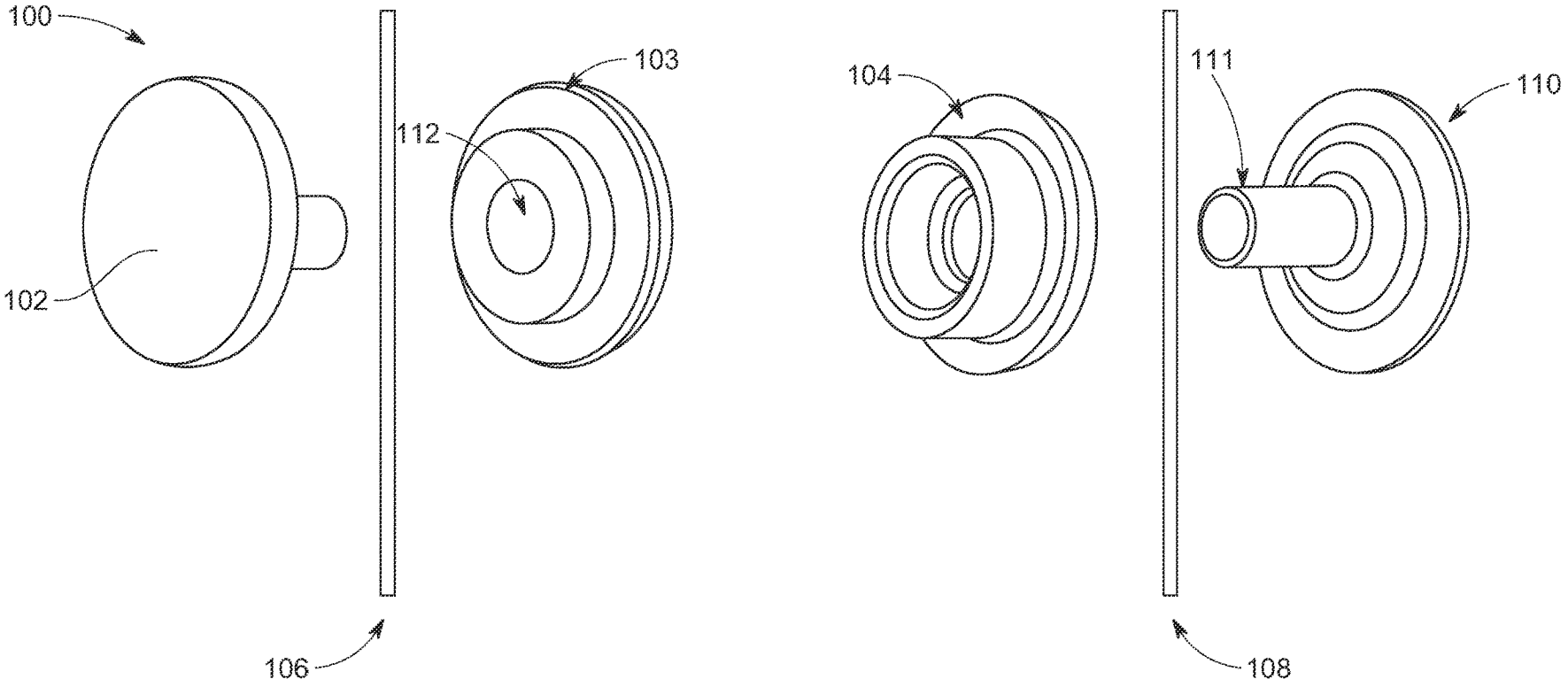
FIG. 1B (PRIOR ART)
FIG. 1B depicts another prior art four piece snap system.

Some existing snap systems 100 may further include a fourth element which is the eyelet 110 as shown in FIG. 1B. Accordingly, in some cases, existing snap systems 100 may incorporate a cap 102, socket 103 and stud 104 that can also be coupled to an eyelet 110. Eyelet 110, as shown in FIG. 1B, includes its own protruding element 112 that couples with the cap 102 and other items.

As shown in in FIG. 1B, the cap 102 is inserted through a hole in the first layer of material 106 (or other item) into the existing opening 112 of the socket 103. In a second layer of material 108, as shown in FIG. 1B, a stud 104 is attached using specialized tools to one side of the second material 108 to fit the pointed barb 111 of the eyelet 110. Accordingly, FIG. 1A and FIG. 1B show examples of existing snap systems 100.

Figure 2A:
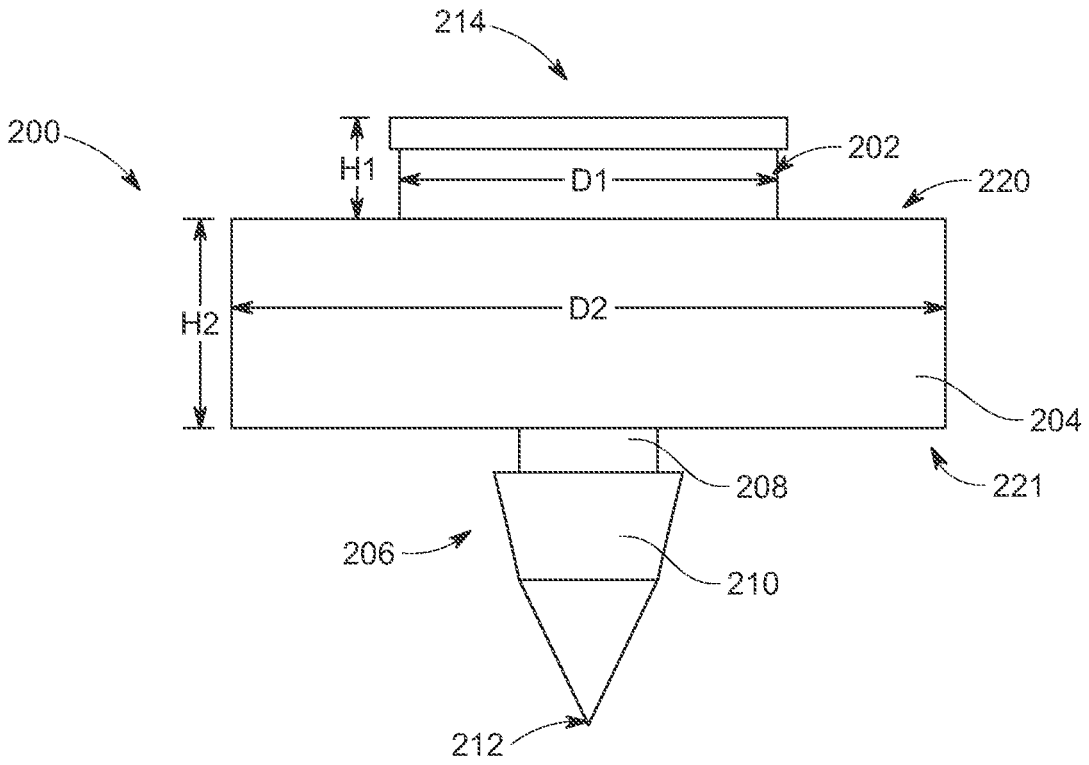
FIG. 2A depicts a front view of a first embodiment of a snap jack according to exemplary embodiments.
Figure 3A:
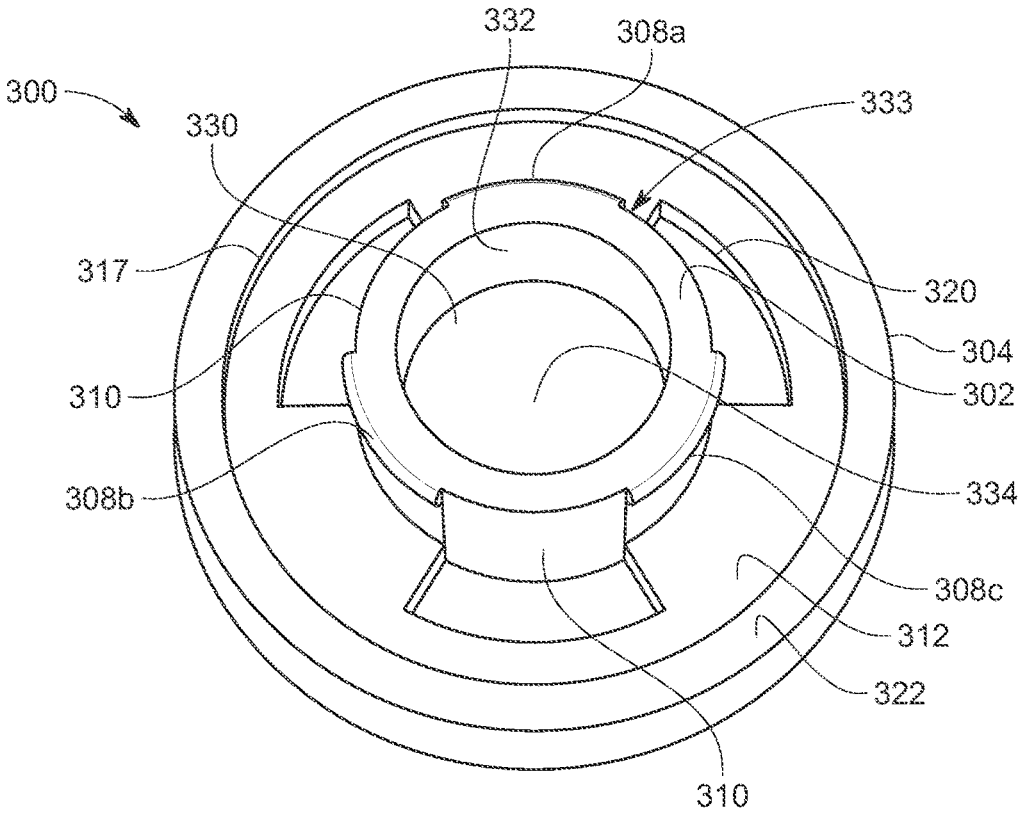
FIG. 3A is a pictorial illustration of a top view of another embodiment of a snap jack fastener.
Figure 3B:
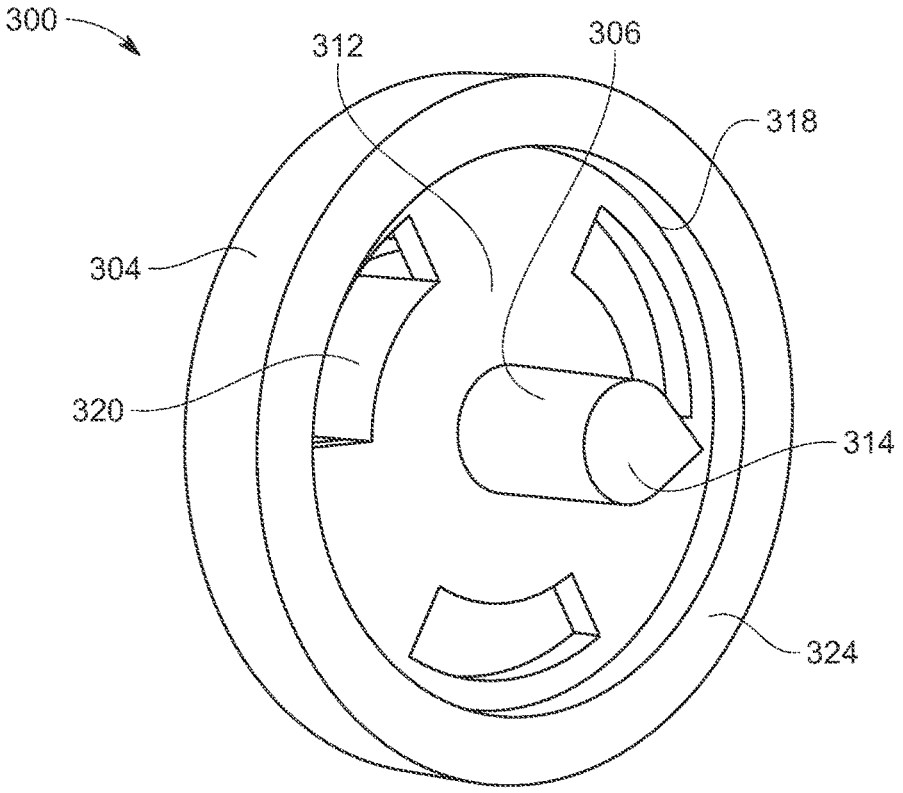
FIG. 3B is a pictorial illustration of a bottom perspective view of the snap jack fastener shown in FIG. 3A.
Figure 3C:
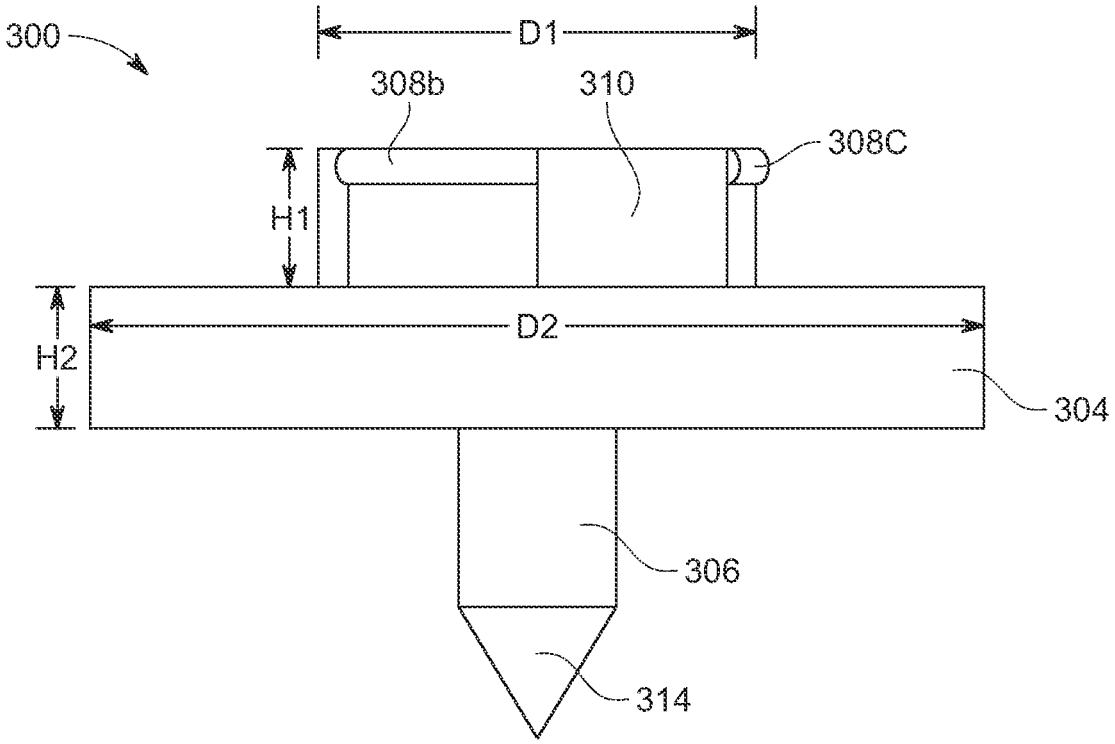
FIG. 3C is a pictorial illustration of a side perspective view of the snap jack fastener shown in FIG. 3A.

FIG. 2A shows a novel snap element to be included in the existing snap systems 100 shown in FIG. 1A and FIG. 1B. It is noted that the new additional snap element, snap jack 200, that may be included into an overall snap system 100, such as that shown in FIG. 1B, is shown as an example and a non-limiting embodiment. Further, FIGS. 3A-3C show another non-limiting exemplary embodiment of a snap jack fastener 300.

Figure 2B:
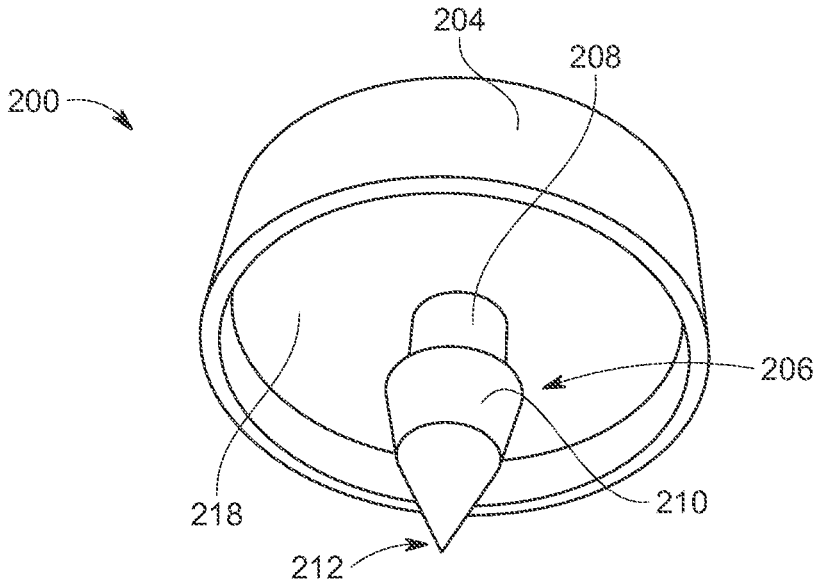
FIG. 2B depicts a bottom isometric perspective view of the snap jack shown in FIG. 2A.

Snap jack 200, as shown in FIGS. 2A-2B, is a new and useful snap element that, in one or more non-limiting embodiments, can include a top protruding element 202, a ring 204, and a lower protruding element 206. Top protruding element 202 is formed with or otherwise coupled to a top surface 220 of the ring 204, and the bottom protruding element 206 is formed with or otherwise coupled to the bottom surface 221 of the ring 204. The top protruding element 202 may have a diameter D1, as shown in FIG. 2A that is narrower or smaller than the diameter D2 of ring 204. The height H1 of the top protruding element 202 may be longer than the height H2 of the ring 204. The ring 204 may act as a connecting element between the top protruding element 202 and the bottom protruding element 206, as well as a stabilizer to stabilize the structure of the snap jack 200. The top protruding element 202 has an opening 214 in its interior through which other elements of the snap system 300 can be connected.

Figure 4:
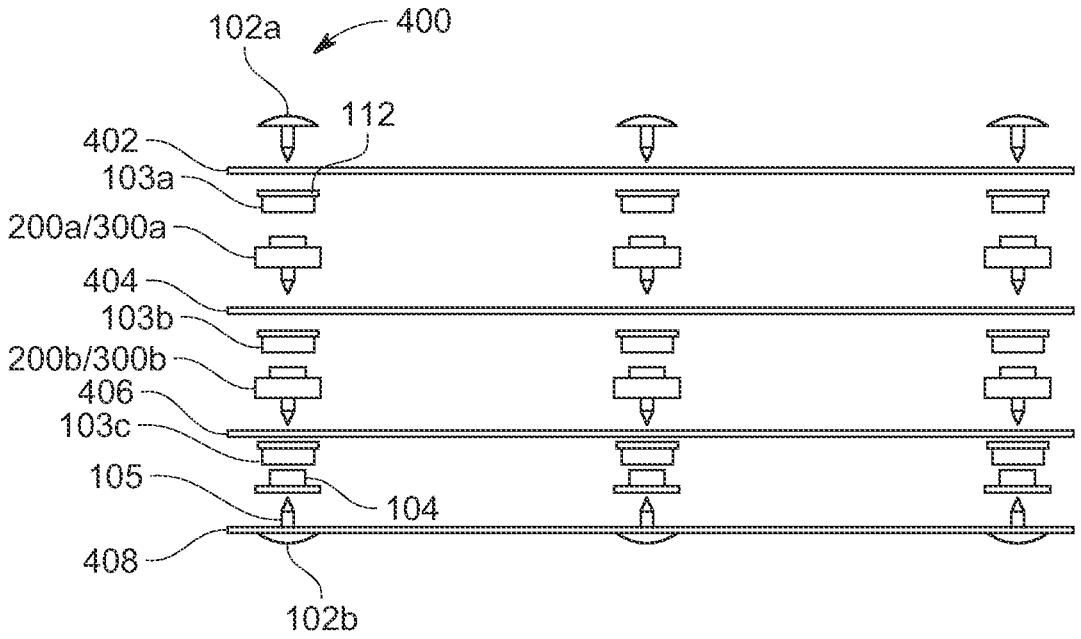
FIG. 4 depicts an exploded view of a snap system that incorporates a snap jack fastener to connect four layers of fabric according to exemplary embodiments.

The bottom protruding element 206 may protrude from the bottom flat surface 218 recessed on the underside of the ring 204. The bottom protruding element 206 may include a top post 208 and a cone shaped barb element 210. The bottom protruding element 206 may have a pointed tip 212 at the end of the cone shaped barb element 210. The cone shaped barb element 210 protruding from the bottom protruding element 206 advantageously acts as a locking element in which a top post 208 is narrower than a top surface of the cone shaped barb element 210. The socket 103 as shown in FIG. 4 goes up over the top post 208 of the cone shaped barb element 210 and once positioned over the top post 208 and the cone shaped barb element 210, the snap jack 200 and socket 103 are locked together. The cone shaped barb element 210 then locks into the opening 112 of the socket 103 and stays securely positioned in place. In a non-limiting embodiment, once the barb element 210 is attached to the socket 103, the two elements cannot be easily detached or removed from each other.

Advantageously, the top protruding element 202 and the bottom protruding element 206 can each separately attach to another element of the snap system 300 as shown in FIG. 3 and FIG. 4 and further described below. It is noted that in other embodiments the barb element 206 may have a different shape than that shown in FIG. 2-4. In other embodiments, the barb element 206 may be long and skinny without the cone shape and may have a pointed end or tip 212.

FIGS. 3A-3C show another non-limiting example of a snap jack fastener 300. FIG. 3A shows a top perspective view of snap jack fastener 300, while FIG. 3B shows a bottom perspective view, and FIG. 3C shows a side view according to an exemplary non-limiting embodiment.

The snap jack fastener 300 has many similar features to the snap jack fastener 200 shown in FIGS. 2A-2B, including a top protruding element 302 which has a same purpose and function as top protruding element 202 shown in FIGS. 2A-2B. Ring 304 shown in FIGS. 3A-3C has the same purpose and function as ring 204 shown in FIGS. 2A-2B. Bottom protruding element 306 as shown in FIGS. 3A-3C has the same purpose and function as bottom protruding element 206 as shown in FIGS. 2A-2B.

As shown in FIGS. 3A-3C, the snap jack fastener 300 comprises a top protruding element 302 that is coupled at the lowermost surface (e.g., closed bottom surface 334) of the top protruding element 302 to a generally flat plate 312 of the ring 304. The plate 312 of the ring 304 of the snap jack fastener 300 is recessed. There is a border wall 317 that encircles the plate 312 of the ring 304 and a top edge 322 of the ring 304 is raised above the plate 312 above the border wall 317. The top protruding element 302 protrudes upwardly away from the plate 312 and the ring 304 in a generally central location of the plate 312. The top protruding element 302 comprises a cylindrical shaped body with a central opening or interior cavity 330 that terminates at the bottom closed surface 334 of the top protruding element 302. In a non-limiting embodiment, the top protruding element 302 includes a set of or a plurality of lips 308*a*, 308*b*, 308*c* that are spaced apart from each other by separations 310. The plurality of lips 308*a*, 308*b*, 308*c* may protrude outwardly from a top edge 333 of the top protruding element 302 according to one or more non-limiting embodiments. In a non-limiting embodiment, there may be a greater or lesser number of lips 308 that function to further secure the snap jack 300 into a socket 103 (e.g., as shown in FIG. 4 and in FIG. 5). Further, there may be one full lip 308 that extends around the full perimeter. In a non-limiting embodiment, the lips 308*a*, 308*b*, and 308*c* may help in the mating process when a socket, such as socket 103*a* is jointed with a top of the snap jack fastener 300 (e.g., as shown in FIG. 4). Once the socket 103*a* is mated together with the top protruding element 302 of the snap jack fastener 300, the lips 308*a*, 308*b*, and 308*c* may help to keep the socket 103*a* and snap jack fastener 300 as well as an attached fabric layer (e.g., fabric layers 404 or 406) together when placed in tension by tugging. The lips 308 function to help the snap jack 300 connect to the socket 103 in a manner that the lips 308 contract upon having a socket 103 positioned over the lips 308, and then the lips 308 expand outwardly again so that the lips 308 are aligned with or slightly protruding above a top surface 113 of a socket 103. The lips 308 help provide resistance to prevent the socket 103 and top protruding element 304 of the snap jack fastener 300 from coming apart or detaching.

In a non-limiting embodiment, the bottom protruding element 306 protrudes from plate 312 on the underside of the ring 304 and is generally centrally positioned on the plate 312 on the underside of the ring 304. As shown in FIG. 3C, the top protruding element 302 and the bottom element 306 are generally aligned along a longitudinal axis and are generally centrally positioned on each respective side of the snap jack fastener 300. The bottom protruding element or member 306 has a terminal pointed end 314 which is intended to be a piercing element similar to the pointed barb 105 on a cap 102. The terminal pointed end 314 is intended to be used to pierce through a layer of fabric or another type of material, such as the layers 402, 404, 406, and 408 shown in FIGS. 4-5 or the layers of material shown in FIGS. 7-15. In a non-limiting embodiment, the bottom protruding element 306 may have a cylindrically shaped upper portion with a conical shaped pointed end 314 as shown in FIG. 3B and FIG. 3C.

The bottom protruding element or member 306 shown in FIGS. 3A-3C may be different in the manner in which the cone-shaped barb element 210 protruding from the bottom protruding element 206 of the snap jack 200 connects to a socket 103, such as the socket 103 shown in FIG. 4. The bottom protruding element or member 306 shown in FIGS. 3A-3C does not include a cone shaped barb element 210 which acts as a locking element. Rather, the bottom protruding element or member 306 may work by plastic deformation when the terminal pointed end 314 and the bottom portion 306 mesh with the interior opening 112 of a socket 103. In this sense, the bottom portion 306 of the snap jack fastener 300 is sized to fit the opening 112 of a socket 103 and inserted such that the bottom portion 306 meshes and mates with the socket 103 through deformation. Once inserted, the snap jack fastener 300 is not easily removable or able to be pulled out or through the connected socket 103.

The bottom protruding element 306 extends downwardly away from the plate 312 on the underside of the ring 304. In a non-limiting embodiment, there may be some openings 320, as shown in FIGS. 3A-3C distributed around the top protruding element 302 and that extend through the body of the plate 312, but this may be more for manufacturing purposes, including manufacturing processes that utilize injection molding. In other non-limiting embodiments, these openings 320 may be omitted.

As shown in the side view in FIG. 3C, the diameter D2 of the ring 304 may be wider than the diameter D1 of the top protruding element 302. In a non-limiting embodiment, the height H1 of the top protruding element 302 may be higher or longer than the height H2 of the ring 304, however that is also variable depending on one or more non-limiting embodiments.

Figure 5:
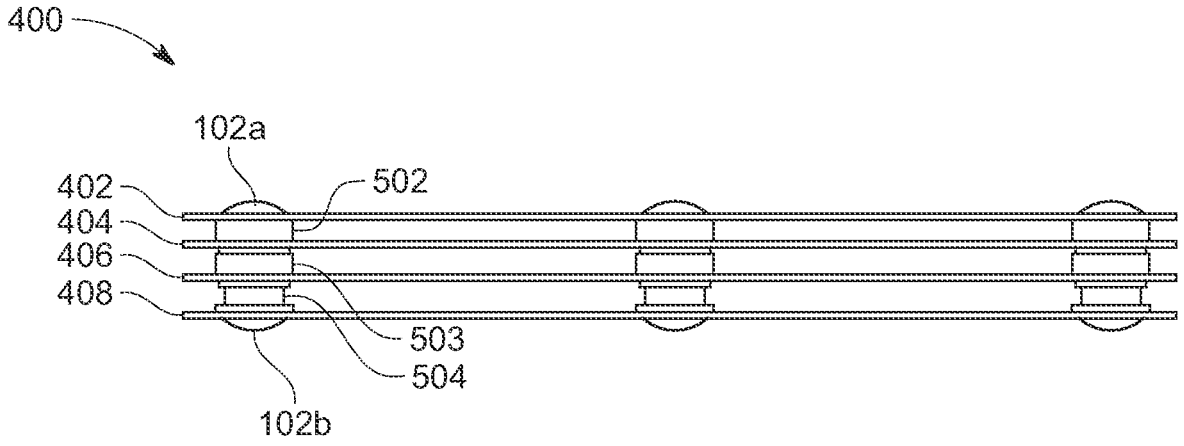
FIG. 5 includes an assembled view of the components shown in FIG. 4 according to exemplary embodiments.

Advantageously, the snap jack fastener 200 and 300, as shown in FIGS. 2A-3C have dual sided mating components (e.g., top protruding elements 202,302 and bottom protruding elements 206,306) that allow for connecting to multiple intermediary sockets 103 in between layers of fabric or other material that are then connecting to beginning and terminal snap caps 102 and one or more intervening studs 104 (e.g., as shown in FIG. 4 and in FIG. 5).

FIG. 4 shows an exploded view of the novel snap system 400 that includes the snap jack fasteners 200 and/or 300 as shown in FIGS. 2A-2B and FIGS. 3A-3C. FIG. 4 shows the assembled view of the snap system 400 shown in FIG. 4. The snap jack fastener 200, 300 as shown in FIGS. 2A-3C can be used to couple a plurality of layers of material together, including more than two layers of material or fabric or other elements together.

As shown in an example of how the snap jack fastener 200 or 300 may be used in FIG. 4, the first cap 102*a* may be fitted through an existing hole or otherwise pierced through the first layer 402 and into an opening 112 of the first socket 103*a*. Then, the top protruding element 202, 302 of the snap jack 200, 300 may be inserted through the opening 112 of the first socket 103*a*, as shown in FIG. 4, while the bottom protruding element 206, 306 of the first snap jack 200*a*, 300*a* may be insertable through the second layer 404. In this manner, the first socket 103*a* is mated or coupled with the first snap jack fastener 200,300. The bottom protruding element 206, 306 of the snap jack fastener 200, 300 may further be inserted through the opening 112 of the second socket 103*b*, as shown in FIG. 4. Then, the bottom protruding element 206, 306 of the snap jack fastener 200, 300 and the pointed end 212, 314 of the second snap jack 200*b*, 300*b* is insertable through the third layer 406 and through the opening 112 of the third socket 103*c*.

Because there are no intervening additional layers after the third layer 406 to the final layer 408, a stud 104, as shown in FIG. 1A and in FIG. 4, can be used to connect cap 102*b* as shown in FIG. 4 to the final layer 408. If there are any additional layers of fabric or material, then the user would couple additional sockets 103 to the top protruding elements 302 of the snap jack fastener 300 and insert the bottom pointed end 314 of the additional snap jack fastener 300 through the additional layers of fabric or other material until a terminal layer is reached.

As shown in FIG. 4, the second cap 102*b* is inserted through the fourth layer 408 such that the pointed barb element 105 of the second cap 102*b* pierces through the fourth layer 408 and protrudes through the opening of the stud 104. The protruding element 107 of the stud 104 is oriented to fit in the opening 112 of the third socket 103*c* through the underside 115 of the stud 104. Accordingly, FIG. 4 shows how the snap jacks 200*a*,300*a* and 200*b*,300*b* can be used to couple more than two layers (e.g., 402-408) of fabric, material, or any other item together regardless of the material used for the layers 402-408. Further, more layers 402-408 can be continuously coupled together by using any number of sockets 103 and snap jacks 200,300 as shown in FIGS. 2A-3C until the desired number of layers have been coupled together with the multifunctional snap system 400, and then the stud 104 and final cap 102*b* may be added to the final layer (e.g., 408). Advantageously, the snap jack 400 has a protruding element that protrudes from each side of the ring 204,304, such as top protruding element 202,302 and bottom protruding element 206,306, that allows the snap jack 200,300 to be coupled from each side to multiple sockets 103 of a snap jack system 400 and to couple together multiple layers 402-408.

FIG. 5 shows an exemplary view of how the snap jack fasteners 200,300 and other elements described above in the novel snap jack system 400 may appear when assembled together and fitted through all of the layers 402-408. As shown in FIG. 5, 502 is the combination of the first snap jack 200*a*, 300*a* and the first socket 103*a*. 503 is the combination of the second snap jack 200*b*, 300*b* and the second socket 103*b*. 504 is the combination of the stud 104 and the third socket 103*c* used to couple the layers 402-408 together which are capped on either side by the first cap 102*a* and the bottom cap 102*b*.

There are multiple possible applications and implementations in which the snap jack system 400 in which snap jack fastener 200, as shown in FIGS. 2A-2B or snap jack fastener 300, as shown in FIGS. 3A-3C may be useful. FIGS. 6-15 show various examples of how the snap jack system 400 may be used to couple two or more layers together in various applications. Either the snap jack 200 shown in FIG. 2A-2B or the snap jack 300 shown in FIGS. 3A-3C may be used for the applications shown in FIGS. 6-16.

Further, it is noted that in another non-limiting embodiment, the bottom protruding member 206/306 of snap jack fastener 200/300 may comprise a screw having threads instead of the smooth piercing end shown in FIGS. 2A-2B as bottom protruding member 206 having a cone shaped barb 210 or the terminal end 314 shown in FIGS. 3A-3C. Rather, the bottom protruding member 206/306 of snap jack fastener 200/300 has a screw with threads that can be threadably fastened and inserted into a socket 103 having a complementary threaded interior rather than a smooth interior of the socket 103 shown in FIG. 1A and FIG. 1B. When enough layers of fabric or other material are coupled together, a terminal stud 104 may be joined to a cap 102 as shown in FIG. 4 and in FIG. 5, in conjunction with one or more snap jack fasteners 200/300 having a threaded screw for the bottom protruding member 206/306 in conjunction with threaded sockets 103.

Figure 6:
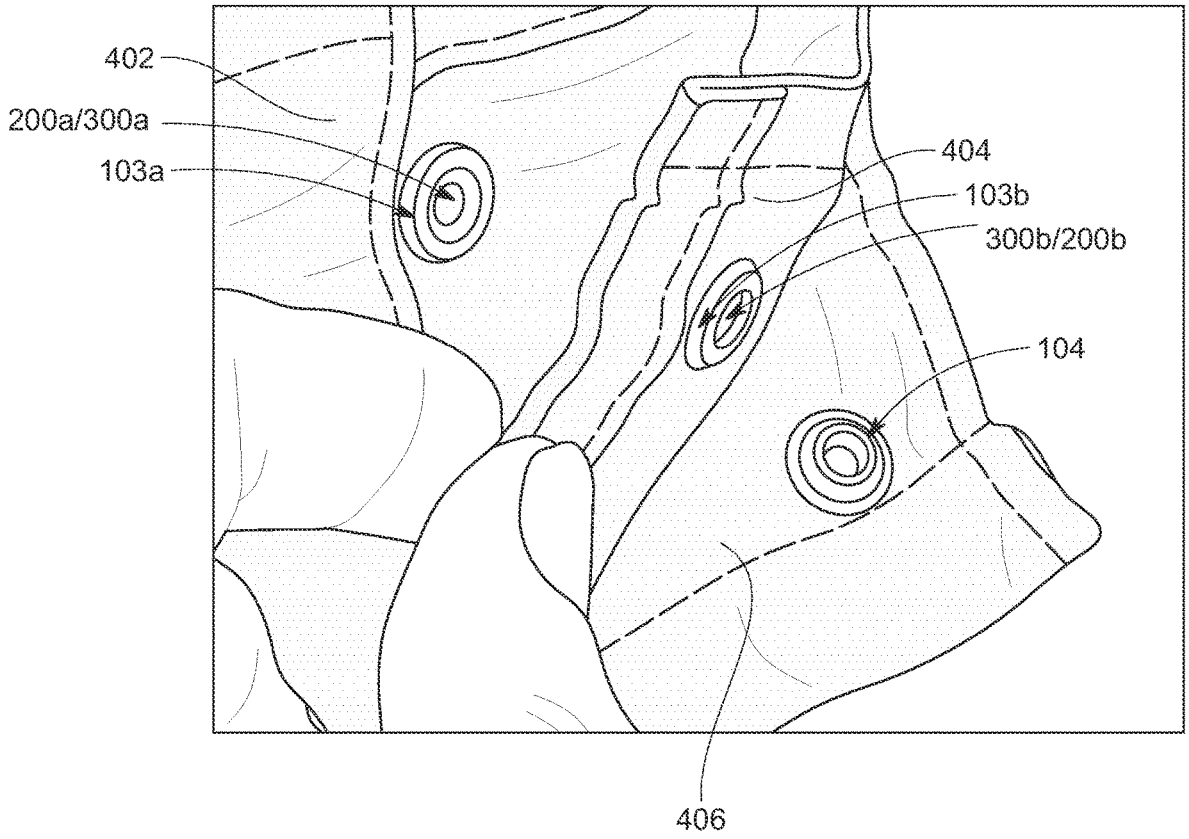
FIG. 6 is a pictorial illustration of multiple layers of fabric connected together using the snap jack.

FIG. 6 depicts a pictorial illustration in which the snap jack system 400 may be utilized so that multiple layers (e.g., in this case first layer 402, second layer 404, and third layer 406) can be snapped together as needed. The first snap jack 300*a* is insertable through a first layer 402 and through the first socket 103*a*. The second snap jack 300*b* may be insertable through the second layer 404 and through the second socket 103*b*. The stud 104 may be inserted through the bottom or third layer 406. While not shown in FIG. 6, there may be a first cap 102*a* (not shown in FIG. 6) inserted through the first layer 402 and through the socket 103*a*. Further, there may also be a second cap 102*b* (not shown in FIG. 6) inserted from the other side of the third layer 406 through the opening of the stud 104. In this manner, the user can snap and unsnap the first layer 402, second layer 404, and third layer 406 together using the snap jack system 400 because of the dual sided mating components of the snap jack fastener 300. This may be preferable in some cases to using buttons and button holes or other attachment mechanisms known in the art.

Figure 7:
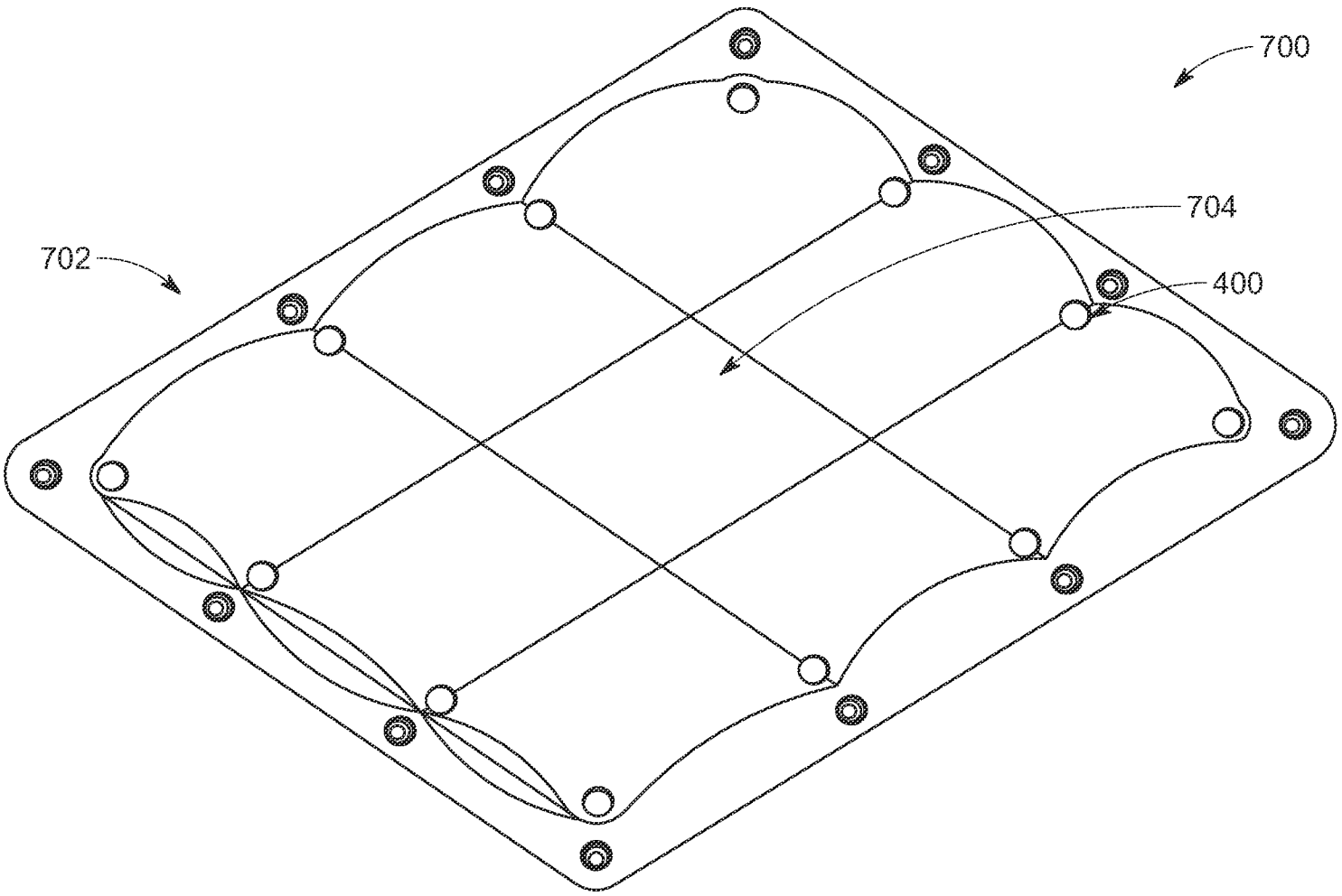
FIG. 7 is a pictorial illustration of an exemplary duvet cover system that incorporates the snap jack system.

FIG. 7 shows an example of a first bedding system 700 that may utilize the snap jack system 400 shown in FIG. 4 and FIG. 5. As shown in FIG. 7, a duvet cover 702 may be removably connectable or attachable to a duvet insert 704 using the snap jack system 400 shown in FIG. 4 and FIG. 5. Several snap jack systems 400 (e.g., as comprised of caps 102, sockets 103, studs 104, and snap jack fasteners 200,300 as shown in FIG. 4 and FIG. 5) may be attached to the duvet cover 702 and to the duvet insert 704 in order to removably snap and unsnap the duvet cover 702 and duvet insert 704 together. The snap jack system 400 may help the user to ensure that the duvet insert 704 is inserted within the duvet cover 702 correctly and held together at multiple points in order to ensure that the duvet insert 704 does not shift or fall within the duvet cover 702 in an undesirable manner. In this manner, the duvet insert 704 stays in place and can connect to each side of the duvet cover 702. When the user needs to remove the duvet insert 704 for washing purposes or any other reason, the user can easily unsnap the snaps of the snap jack system 400 and reinsert again as needed.

In a non-limiting embodiment, a cap 102 and a socket 103 may extend through a top surface of one or more corners or other locations of a duvet cover 702 through to the underside of the duvet cover 702. Next, a snap jack 200/300 may be coupled to a socket (e.g., as shown in FIG. 4) and attached to one or more corners or other complementary locations on a duvet insert 704 in order for the snap jack 200/300 and socket 103 combination arranged in one or more locations around the duvet insert 704 to be quickly and easily removably attached to the cap 102 and socket 103 combination arranged in one or more locations around the duvet cover 702.

Figure 8:
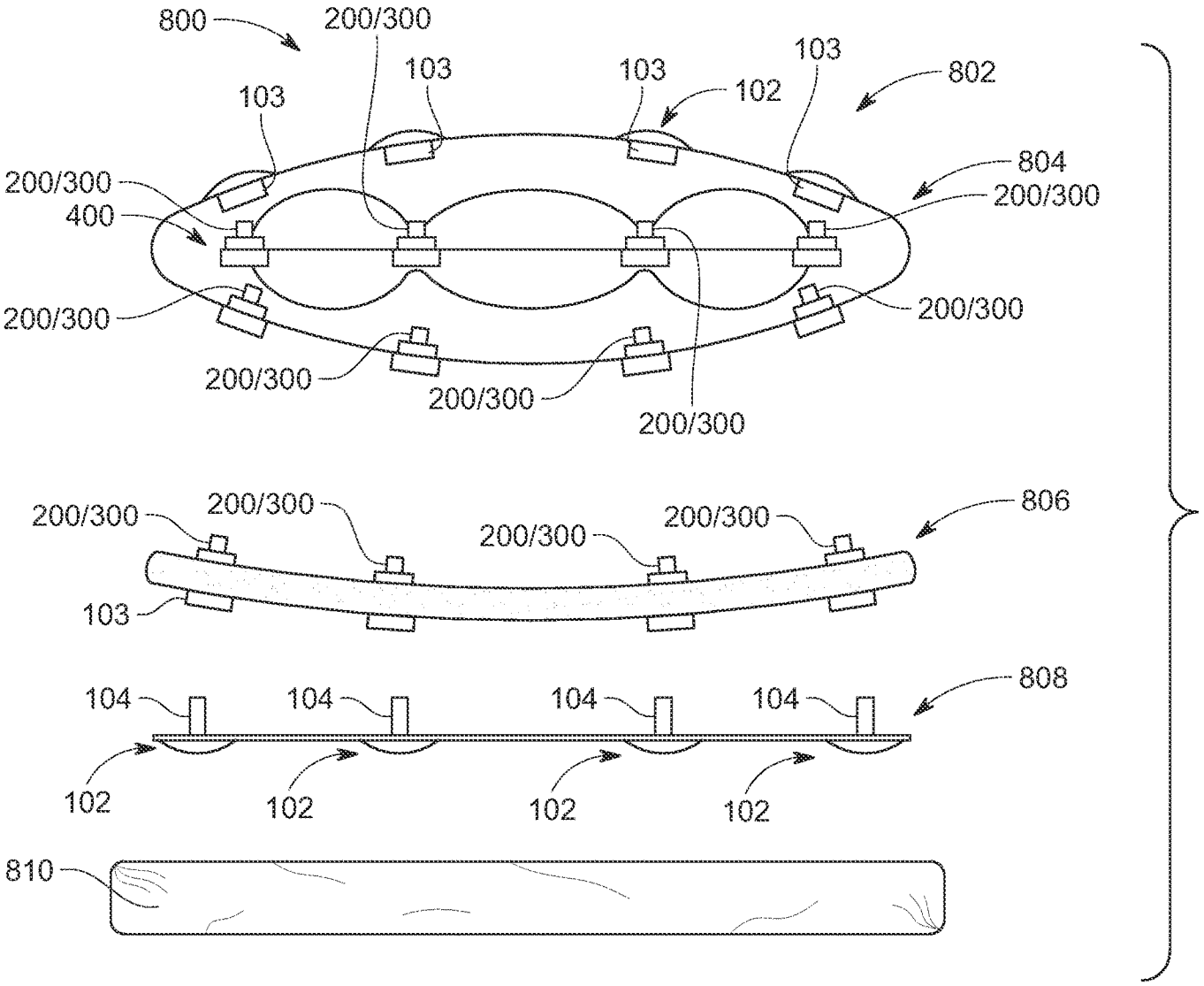
FIG. 8 is a pictorial illustration of an exemplary exploded view of a bedding system that incorporates the snap jack system.

FIG. 8 shows an example of a second bedding system 800 in which the snap jack system 400 may be used. FIG. 8 shows a practical, real example of the use of the snap jacks 200/300 to connect multiple layers of fabric together. FIG. 8 is an exploded view in which all of the layers 802, 804, 806, and 808 are connected together by a real application of the snap jack system 400. The snap jack system 400 may be combined to removably connect a duvet cover 802, a duvet insert 804, a blanket 806, and/or a flat sheet 808 in one or more non-limiting embodiments, which is four different layers of fabric. These items 802-808 may be placed over a mattress 810 and removably snapped together to facilitate their placement over the sleeper when sleeping on the mattress 810. This system allows for easy bed making and aligned bedding throughout the night.

The order of arrangement may be such that one or more caps 102 are inserted into a top side of a duvet cover 802, and one or more sockets 103 coupled to an underside of the cap. One or more snap jacks 200/300 are coupled to a duvet insert 804 so that the snap jacks 200/300 are over a top layer of the duvet insert 804 and one or more sockets positioned underneath an outer surface of the duvet insert 804. The snap jacks 200/300 are oriented in the same way as shown in FIG. 4, such that a top protruding element 204/304 of the snap jacks 200/300 is inserted into the opening 112 of a socket 103, while the bottom protruding element 206/306 is inserted into a fabric layer (e.g., of 802, 804, 806, and 808) and then into a top opening 112 of another socket 103.

One or more snap jacks 200/300 are also coupled to a bottom surface of the duvet cover 802, as shown in FIG. 8. The snap jack fasteners 200/300 removably connect the duvet insert 804 within the duvet cover 802 to make changing and removing the duvet cover 802 an easier process.

Further, FIG. 8 shows additional fabric layers comprising blanket 806 and flat sheet 808 can be connected via the same combination of snap jack fasteners 200/300 and sockets 103 until a final layer of fabric (e.g., flat sheet 808) is reached. One or more caps 102 may be inserted through an underside of the flat sheet 808 and connected to one or more studs 104 that connect to a last set of sockets 103 coupled to the bottom pointed ends 206/306 of the last set of snap jack fasteners 200/300. In this manner, the system 400 represented in FIG. 4 and FIG. 5 may be used to couple the four main layers of fabric 802, 804, 806, and 808 that are part of the overall bedding system 800 shown in FIG. 8.

Figure 9:
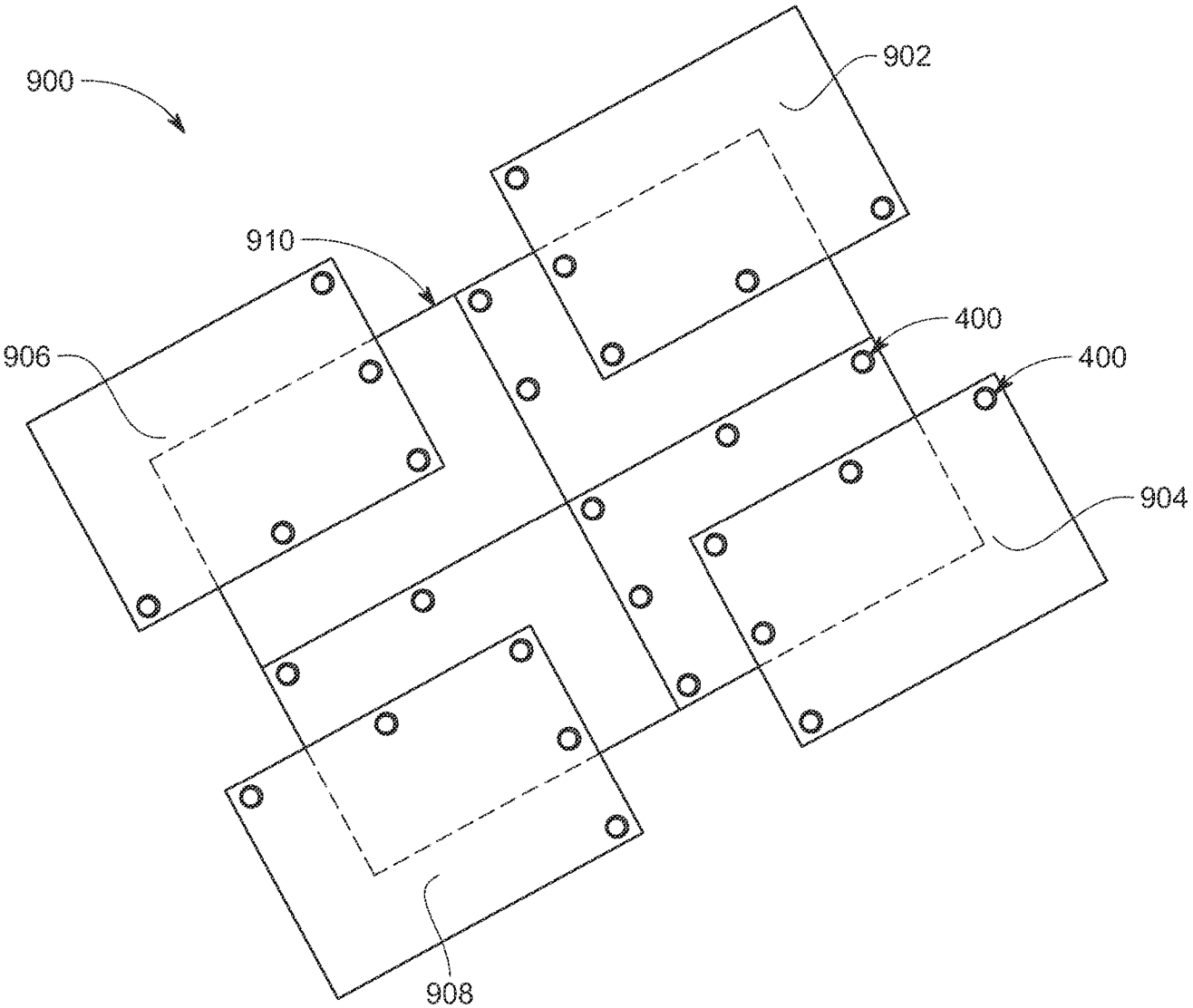
FIG. 9 is a pictorial illustration of an exemplary segmented duvet cover that incorporates the snap jack system.

FIG. 9 shows an example of a segmented duvet cover 900 that may incorporate the snap jack system 400 shown in FIGS. 4-5. In a non-limiting embodiment, duvet cover 900, as shown in FIG. 9, may incorporate four segmented, detachable pieces 902, 904, 906, and 908. Several snap jack systems 400 may be attached to various sides and locations of the segmented, detachable pieces 902-908 and to the duvet insert 910, as shown in FIG. 9. The ability to segment and detach various pieces 902-908 of the duvet cover 900 may facilitate washing the duvet cover 900, in particular, for smaller sized washing machines or if only one or two specific pieces of the duvet cover 900 need washing or fixing for any reason. The snap jack system 400 of FIG. 4 and FIG. 5 may be used to easily snap open and to close various components of the segmented duvet cover 900 and to removably attach them to the duvet insert 910.

Figure 10:
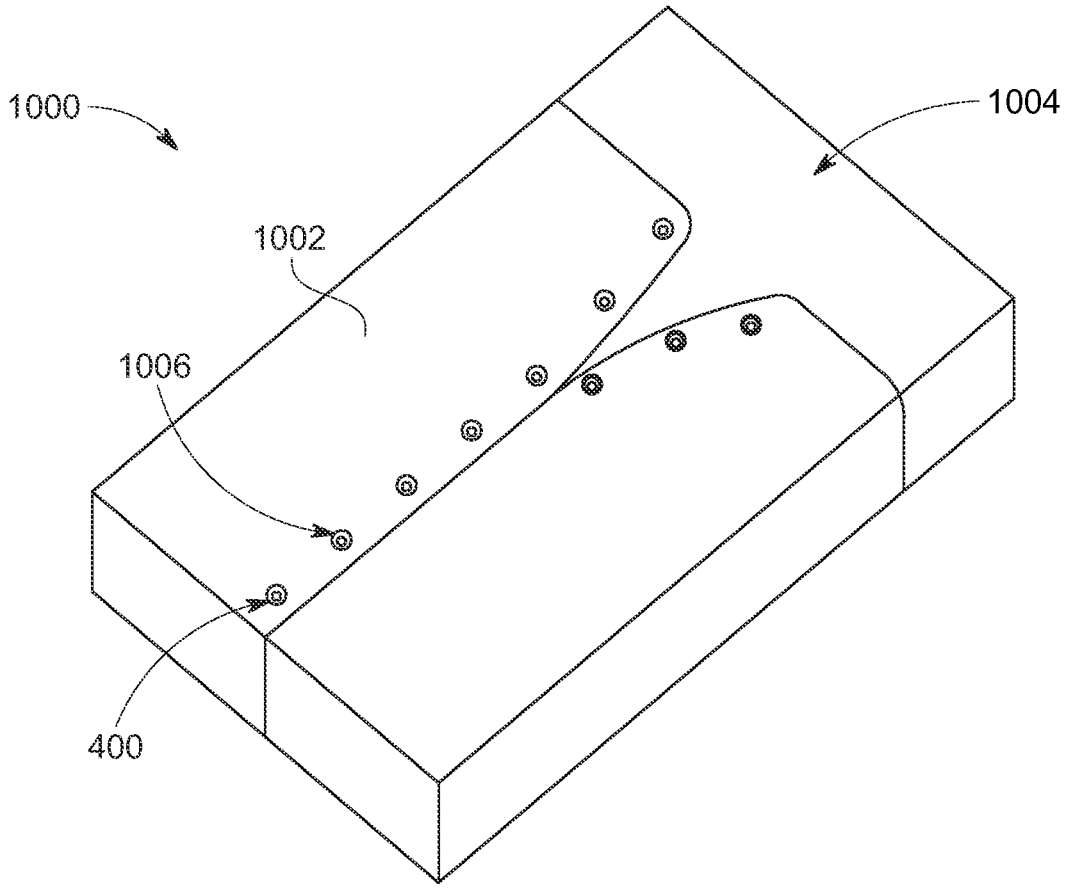
FIG. 10 is a pictorial illustration of a split bed cover that incorporates the snap jack system.

FIG. 10 shows another type of bedding system 1000 that incorporates a split bedding cover 1002. The split bedding cover 1002 may be in the form of either a comforter or a duvet cover which can accommodate a duvet insert (e.g., as shown in FIG. 8-9). As shown in FIG. 10, the bedding cover 1002 may have a split 1006 centrally positioned down the middle of the bedding cover 1002. The snap jack systems 400 may be placed in a series or row on either side of the split 1006 in order for the user to removably position the portion of the bedding cover 1002 the user desires on the mattress 1004. This bedding cover 1002 may facilitate pulling on or off only one section of the split bedding cover 1002. It is known that people often differ in their perceptions of how hot or cold it may be when trying to sleep and may differ over how to set the heating or cooling system in the room where the bed is located. Advantageously, the bedding system 1000 may allow one user/sleeper who is overheating to remove only their section of the split bedding cover 1002 and the other user/sleeper may keep their section of the split bedding cover 1002 for warmth. Additional benefits of the bedding cover 1002 include isolating each partner's movement from the other so as not to disturb one another when sleeping. Additionally, one side or partner can tuck a sheet or blanket at the foot of the bed and the other is free to accommodate the other partner's preference for the sheet or blanket to be untucked. Further, one can add an additional blanket over each partner's side for additional warmth.

Figure 11:
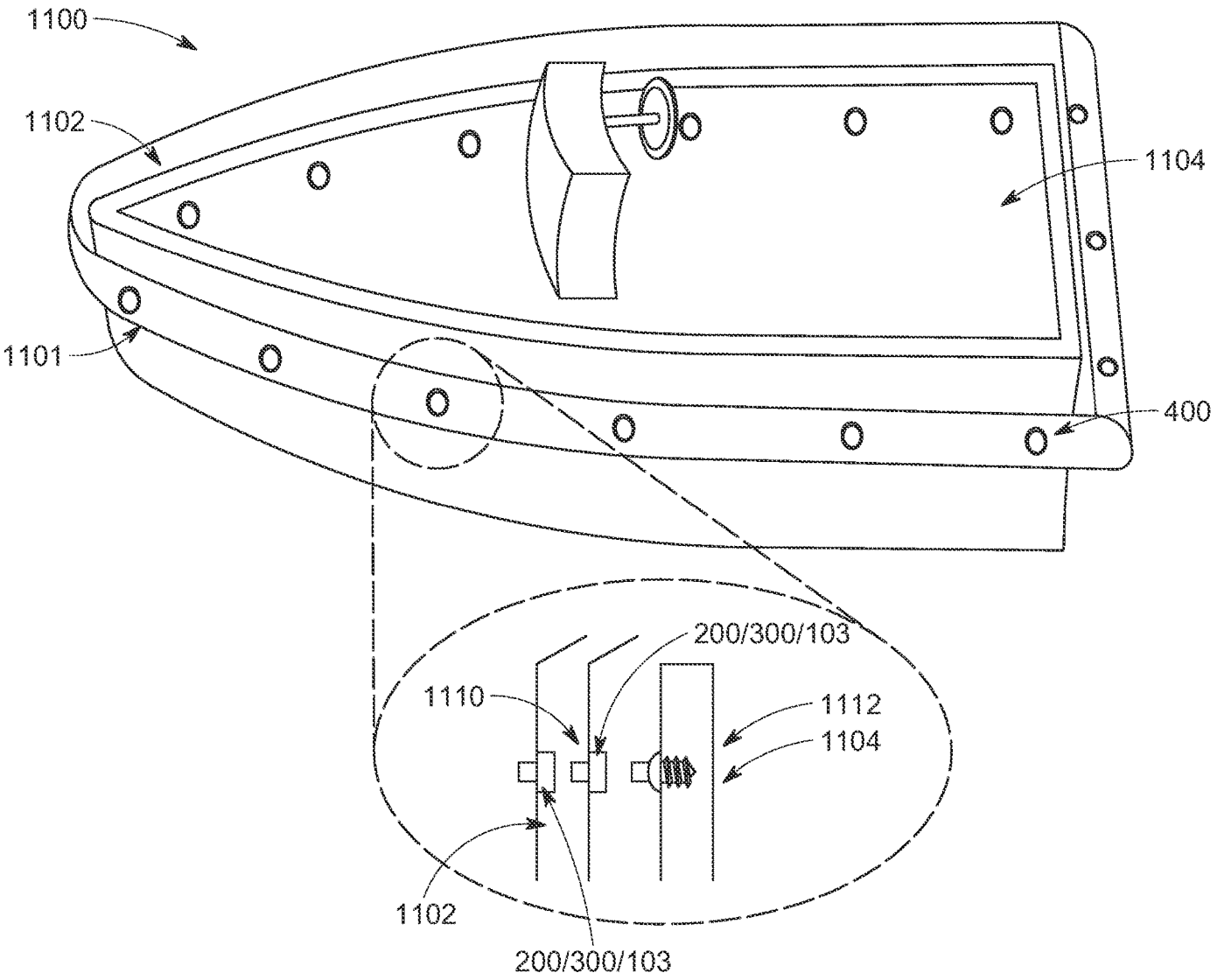
FIG. 11 is a pictorial illustration of a boat that incorporates the snap jack system to removably attach one or more coverings.

FIG. 11 shows an example of how the snap jack system 400 may be incorporated in a boat covering system 1100. The boat hull or body 1104 of a boat 1101 may have a boat cover 1102 that is removably snapped and attached to the boat hull 1104 using one or more snap jack systems 400. The boat cover 1102 may be waterproof and provide coverage. In some additional cases, it may be advantageous to further couple an additional canvas cover 1110 to cover the boat hull 1104. In one or more non-limiting embodiments, various snap jack systems 400 may be incorporated with these covers 1102, 1110. Additionally, the standard snap jack system 400 shown in FIG. 4 and FIG. 5 may be coupled with a cloth-to-surface screw 1112 which may be made of a metal in some cases, including, but not limited to steel. The combination of the snap jack fasteners 200/300 and sockets 103 as shown in FIG. 4, with an existing cloth-to-surface screw 1112 may be particularly useful with attaching items, including fabrics, to metal, glass, plastic, or other materials. In a non-limiting embodiment, the snap jack systems 400 be used along with an existing screw 1112 that is incorporated into the body or hull 1104 of the boat and then various covers 1102 and 1110 can be easily snapped and unsnapped to the body 1104 of the boat 1101 as needed to protect the boat 1101 from rain, sun, or other elements. In other non-limiting embodiments, the snap jack fasteners 200/300 may connect to an existing screw 1112 that can be fastened by screwing the existing screw 1112, as shown in FIG. 11 in a non-limiting embodiment, into a plastic, metal, or other type of stronger material that may benefit from having a threaded portion fastened into the material. An example of such existing steel screws 1112 is the cloth-to-surface stainless steel fasteners produced by DOT for example or other manufacturers. Such existing screws 1112 can be threadably fastened into wood, metal, or glass and then a cap 102 and socket 103 may be connected to an item having a fabric layer. That fabric layer may be connected to the existing steel screw 1112 via the connected cap 102 and socket 103. In a non-limiting embodiment, snap jack fasteners 200/300 can be coupled to one or more sockets 103 so that more than two or three fabric layers can be connected together and then removably coupled to these existing stainless steel screws 1112.

In a non-limiting embodiment, the existing steel (or other material) cloth-to-surface screw 1112 is inserted into a body of the boat hull 1104. Then snap jack fastener 200/300 combinations with sockets 103 as shown in FIG. 4 and in FIG. 5, may be used to further couple a canvas cover 1110 and a waterproof cover 1102.

Figure 12:
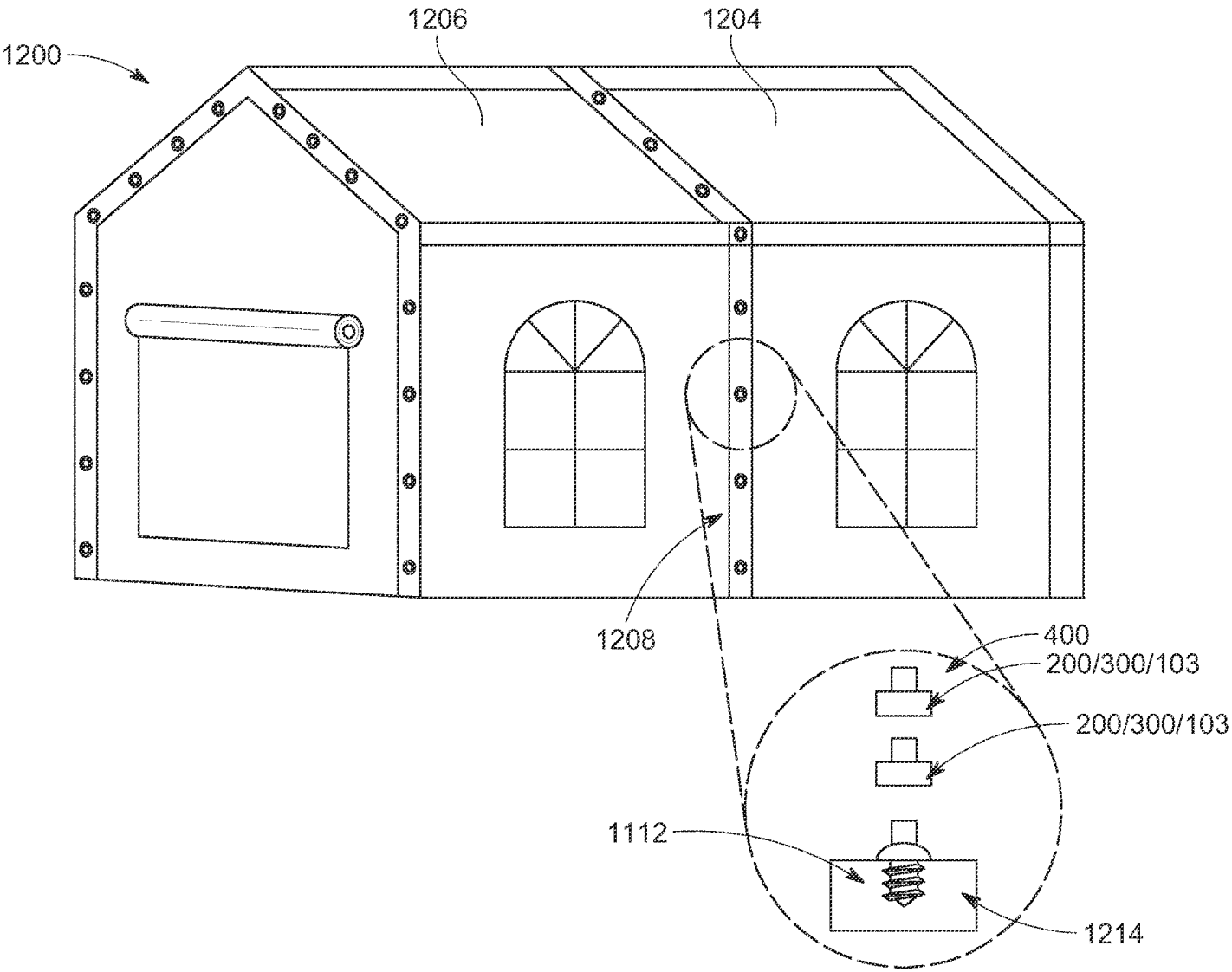
FIG. 12 is a pictorial illustration of an expandable party tent that incorporates the snap jack system.

FIG. 12 shows an example of how the snap jack systems 400 shown in FIG. 4 and FIG. 5 may be used for attaching one or more panels 1204 and 1206 to create expandable tents 1200. As shown in FIG. 12, each panel 1204, 1206 may have a side 1208 that incorporates a number of snap jack systems 400 and then couples these snap jack fasteners 200/300 with sockets 103 to the existing cloth-to-surface steel screws 1112. The user can attach as many panels 1204, 1206 together as needed to create multiple sections and sizes of the desired expandable party tent 1200 using the incorporated snap jack 400 and connect to sturdy existing screws 1112. With the coupling of the snap jack fasteners 200/300 to the existing screws 1112, the panels 1204,1206 may easily attach to metal/plastic poles 1214 used to hold up the tents 1100. Accordingly, an existing cloth-to-surface stainless steel screw 1112 is first inserted into a metal/plastic pole 1214. Then a first panel 1204 is coupled to another panel 1206 with two or more snap jack fasteners 200/300 and socket 103 combinations, as shown in FIGS. 4 and 5 and then coupled to the poles 1214 via the existing cloth-to-surface stainless steel screws 1112.

Figure 13:
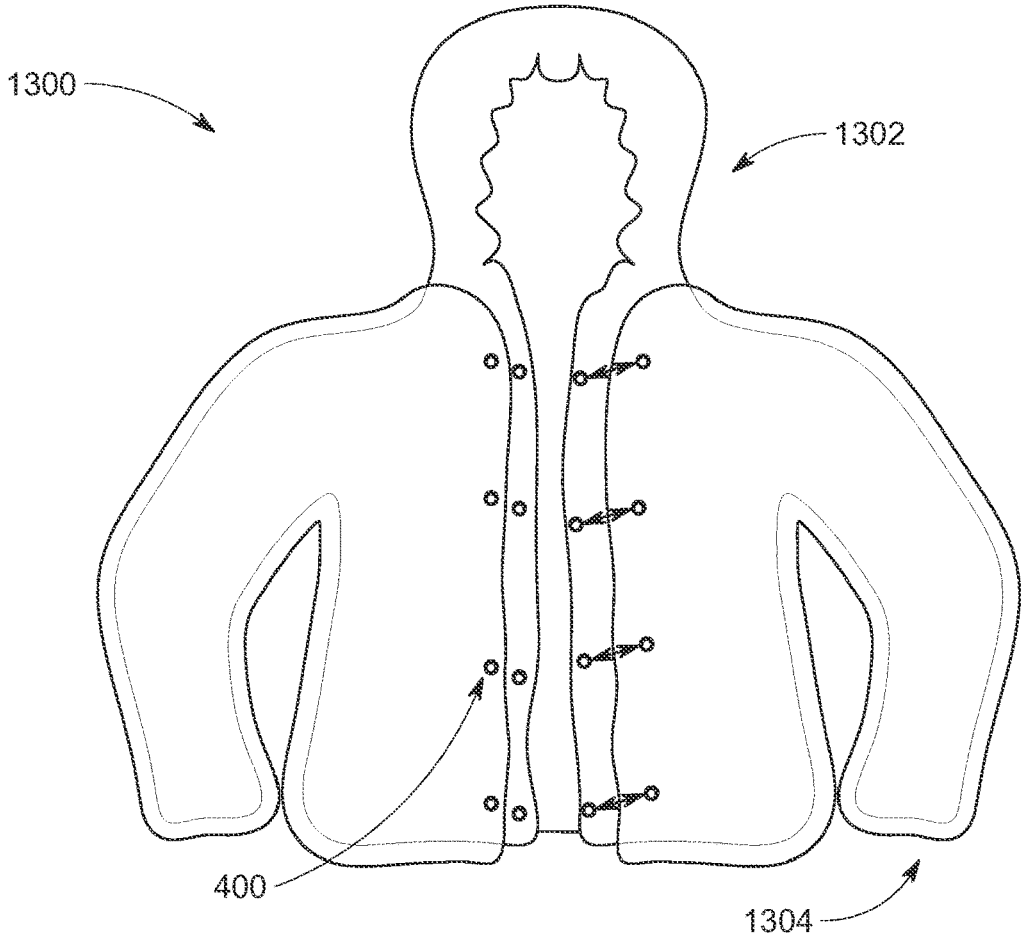
FIG. 13 is a pictorial illustration of a multilayer jacket that incorporates the snap jack system.

FIG. 13 shows how snap jack systems 400 may be incorporated into a multilayer jacket 1200. For the multilayer jacket 1300, the shell 1302 of the jacket 1300 can be removably coupled to a lining 1304, and any other intervening layers, using the incorporated snap jack systems 400 that may be positioned and placed on the jacket 1300 in series or rows. The use of the snap jack systems 400 may facilitate selectively removing the lining 1304 if the user does not want to include the lining 1304. Further, the snap jack systems 400 may replace existing use of buttons, thread, glue, zippers or other forms of attachment to connect multiple layers of fabric or any other non-fabric material together in a variety of clothing applications.

Figure 14:
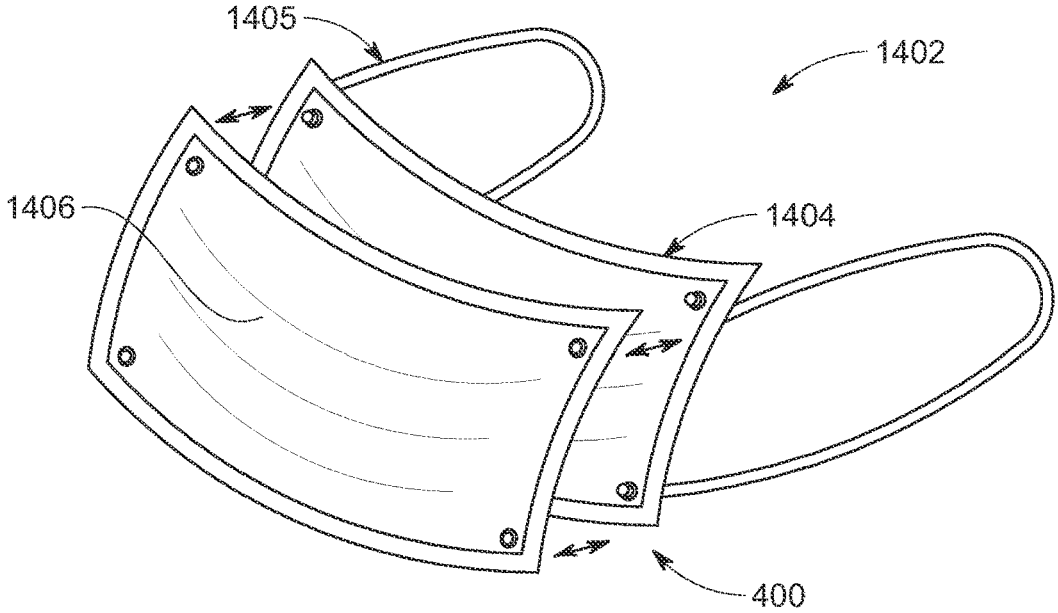
FIG. 14 is a pictorial illustration of a face mask that incorporate the snap jack system.

FIG. 14 shows how snap jack systems 400 may be used with a half face-masks 1402. In the mask 1400 shown in FIG. 14, there may be ear straps 1405 connected to a first face mask layer 1404. Further, it may be possible to incorporate a second face mask/filtering layer 1406 on the front side of the first face mask layer 1404 by incorporating various snap jack systems 400 along the sides or other locations of the first face mask layer 1404 and the second face mask layer 1406. The ability to snap on or off an additional, second layer 1406 to one's face mask 1402 may help further protect the wearer from unwanted viruses, pollutants, or other unwanted elements in the air.

Figure 15:
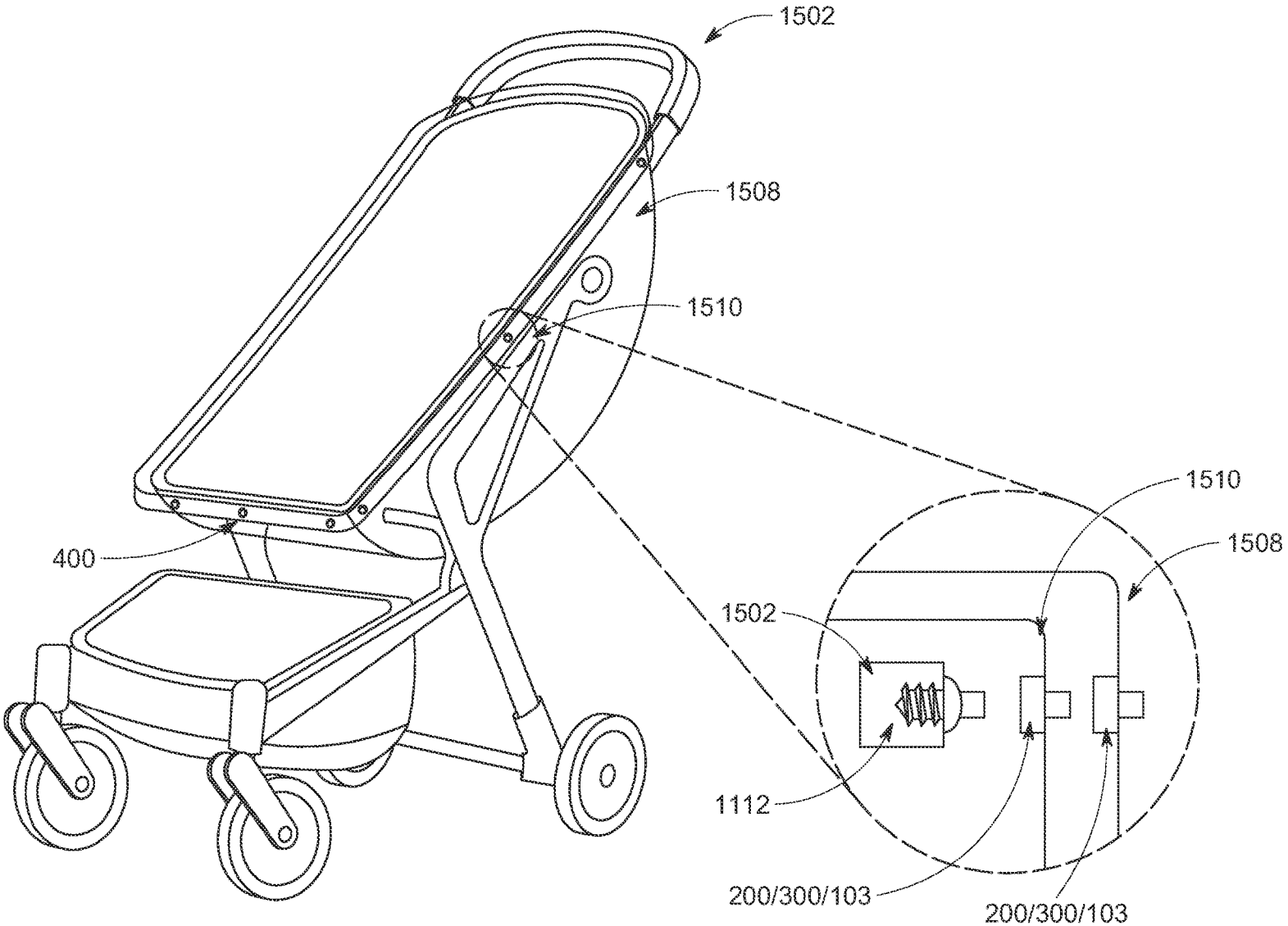
FIG. 15 is a pictorial illustration of a stroller that incorporates the snap jack system.

FIG. 15 shows an example of a stroller 1502 incorporating one or more snap jack systems 400 in order to couple multiple layers to the stroller 1502 to offer additional protection and coverage for a child in the stroller 1502. In a non-limiting embodiment, a first rain proof layer 1508 may be coupled to a second sunshade layer 1510 via one or more snap jack systems 400 placed on the frame of the stroller 1502 and/or on the first rain proof layer 1508 and the second sunshade layer 1510. It is further noted that it may be desirable to incorporate a cloth-to-surface screws 1112, as shown in FIG. 11 to further connect the metallic or plastic frame of a stroller 1502 to the material of the first rain proof layer 1508 and the second sunshade layer 1510. In this manner, the user of the stroller 1502 can easily remove whichever layer 1508, 1510 from the stroller 1502 as desired by unsnapping one or more elements of the snap jack systems 400 or add additional layers 1508, 1510 as needed.

In a non-limiting embodiment, a first rain proof layer 1508 is connected with a first set of snap jack fasteners 200/300 and sockets 103 to the second sunshade layer 1510 and then connects to a second set of snap jack fasteners 200/300 and sockets which are then connected to an existing cloth-to-surface screw type fastener 1112 as previously described and shown in FIG. 11.

Notably, the snap jack fastener device 300 as shown in FIGS. 3A-3C and snap jack fastener 200 as shown in FIGS. 2A-2B has the advantage of having a dual sided attachment system for coupling more than two layers of fabric or other material together. Many other advantages and benefits may be provided by the one or more systems and components described herein.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A snap jack fastener comprising:

a single fastener element having a single body comprising:

a top protruding element comprising a central opening having a closed bottom surface;

a ring that encircles the top protruding element at a lowermost end of the top protruding element, wherein the top protruding element extends upwardly away from a recessed top surface of the ring, wherein a diameter of the ring is wider than a diameter of the top protruding element; and a bottom protruding element that has a pointed, piercing end, wherein the bottom protruding element extends downwardly away from a recessed bottom surface on an underside of the ring and wherein the bottom protruding element is not removable from a top side or the underside of the ring.

2. The snap jack fastener of claim 1, wherein the top protruding element is cylindrically shaped.

3. The snap jack fastener of claim 1, wherein the central opening of the top protruding element does not extend all the way through to the underside of the ring and is stopped at the closed bottom surface of the top protruding element.

4. The snap jack fastener of claim 1, wherein the bottom protruding member comprises a cone shaped barb or a threaded screw instead of a smooth pointed, piercing end.

5. The snap jack fastener of claim 1, wherein the top protruding element of the snap jack fastener further comprises a first lip, a second lip, and a third lip protruding outwardly from a top edge of the top protruding element.

6. The snap jack fastener of claim 1, wherein the bottom protruding member is a cylinder shaped member and comprises the pointed, piercing end.

7. The snap jack fastener of claim 1, wherein the snap jack fastener is part of an overall snap system for snapping together a plurality of layers of fabric or another material, wherein the plurality of layers comprises a number greater than at least two layers.

8. A snap jack fastener comprising:

a single fastener element having a single body comprising:

a top protruding element comprising a central opening having a closed bottom surface, wherein the top protruding element of the snap jack fastener further comprises a at least one or more lips that protrude outwardly from a top edge of the top protruding element, wherein the top protruding element is cylindrically shaped;

a ring that encircles the top protruding element at a lowermost end of the top protruding element, wherein the top protruding element extends upwardly away from a recessed top surface of the ring, wherein a diameter of the ring is wider than a diameter of the top protruding element; and a bottom protruding element that has a pointed, piercing end, wherein the bottom protruding element extends downwardly away from a recessed bottom surface on an underside of the ring and wherein the bottom protruding element is not removable from a top side or the underside of the ring.

9. The snap jack fastener of claim 8, wherein the bottom protruding member comprises a threaded screw instead of a pointed, piercing end.

10. The snap jack fastener of claim 8, wherein the bottom protruding element comprises a cone shaped barb having the pointed, piercing end.

11. A method for using a snap jack fastener to connect a plurality of layers using a snap system, comprising:

a) providing one or more caps, one or more studs, and one or more sockets as part of the snap system;

b) providing one or more snap jack fasteners, wherein each snap jack fastener comprises:

a single fastener element comprising a single body comprising:

a top protruding element comprising a central opening having a closed bottom surface;

a ring that encircles the top protruding element at a lowermost end of the top protruding element, wherein the top protruding element extends upwardly away from a recessed top surface of the ring, wherein a diameter of the ring is wider than a diameter of the top protruding element; and a bottom protruding element that has a pointed, piercing end, wherein the bottom protruding element extends downwardly away from a recessed bottom surface on an underside of the ring and wherein the bottom protruding element is not removable from a top side or the underside of the ring c) inserting a pointed end of a first cap into a first layer of fabric or another material;

d) coupling or mating a first socket to the pointed end of the first cap;

e) coupling or mating a first snap jack fastener to an underside of the first socket, wherein a top protruding element of the first snap jack fastener fits within an internal cavity of the first socket;

f) inserting a pointed, piercing end of the first snap jacket into a second layer of fabric or another material;

g) coupling or mating a second socket to the first snap jack fastener, wherein the pointed, piercing end of the first snap jack fastener extends through the second layer of fabric or another material and fits within an internal cavity of the second socket;

h) coupling or mating a second snap jack fastener to the second socket, wherein a top protruding element of the second snap jack fastener fits within an internal cavity of the second socket;

i) adding a third layer of fabric or another material;

j) inserting a pointed, piercing end of the second snap jack fastener into the third layer of fabric layer or another material;

k) adding additional sockets, snap jack fasteners, and additional layers as desired in a same order as steps (c)-(j); and l) once a terminal layer of fabric or another material is provided, inserting a pointed end of a terminal cap up through the terminal layer of fabric or another material and into a stud that is coupled to a terminal socket.

12. The method of claim 11, wherein the top protruding element is cylindrically shaped.

13. The method of claim 11, wherein the central opening of the top protruding element does not extend all the way through to the underside of the ring and is stopped at the bottom surface of the top protruding element.

14. The method of claim 11, wherein the bottom protruding element comprises a cone shaped barb.

15. The method of claim 11, wherein the bottom protruding element is a cylinder shaped member with a pointed terminal end.

16. The method of claim 11, wherein the snap jack fastener is part of an overall snap system for snapping together a plurality of layers of fabric or another material, wherein the plurality of layers comprises a number greater than at least two layers.

17. The method of claim 11, wherein the first layer, the second layer, and the additional layers of fabric or another material are part of a bedding system.

18. The method of claim 11 wherein the first layer, the second layer, and the additional layers of fabric or another material are part of a tent securing system.

19. The method of claim 11, wherein the first layer, the second layer, and the additional layers of fabric or another material are part of a stroller covering securing system.

20. The method of claim 11, wherein the first layer, the second layer, and the additional layers of fabric or another material are part of a boat covering securing system.

* * * * *